US006789620B2

(12) United States Patent
Schultz et al.

(10) Patent No.: US 6,789,620 B2
(45) Date of Patent: Sep. 14, 2004

(54) DOWNHOLE SENSING AND FLOW CONTROL UTILIZING NEURAL NETWORKS

(75) Inventors: Roger L. Schultz, Aubrey, TX (US); Bruce H. Storm, Jr., Houston, TX (US); John R. Dennis, Bozeman, MT (US); John M. Richardson, deceased, late of Edmund, OK (US), by Sandra M. Richardson, legal representative

(73) Assignee: Halliburton Energy Services, Inc., Carrollton, TX (US)

( * ) Notice: Subject to any disclaimer, the term of this patent is extended or adjusted under 35 U.S.C. 154(b) by 77 days.

(21) Appl. No.: 10/076,960

(22) Filed: Feb. 15, 2002

(65) Prior Publication Data

US 2002/0152030 A1 Oct. 17, 2002

(30) Foreign Application Priority Data

Feb. 16, 2001 (WO) ..... PCT/US01/05123

(51) Int. Cl.[7] ..... E21B 47/00; G06F 15/18

(52) U.S. Cl. ..... 166/250.15; 166/250.01; 166/53; 702/6; 702/11; 706/15; 706/929

(58) Field of Search ..... 166/250.01, 254.1, 166/254.2, 255.1, 250.07, 250.11, 250.15, 53; 702/7, 6, 8, 10, 11, 12, 13; 706/929, 1, 15, 44

(56) References Cited

U.S. PATENT DOCUMENTS 5,251,286 A * 10/1993 Wiener et al. ..... 706/20
5,300,770 A * 4/1994 Allen et al. ..... 250/269.5
5,468,088 A * 11/1995 Shoemaker et al. ..... 166/245
5,828,981 A 10/1998 Callender et al.
5,941,305 A 8/1999 Thrasher et al.
6,002,985 A * 12/1999 Stephenson ..... 702/13
6,041,856 A 3/2000 Thrasher et al.
6,044,325 A 3/2000 Chakravarthy et al.
6,236,894 B1 * 5/2001 Stoisits et al. ..... 700/28
6,381,542 B1 * 4/2002 Zhang et al. ..... 702/7
6,424,919 B1 * 7/2002 Moran et al. ..... 702/6

FOREIGN PATENT DOCUMENTS

| | | |
|---|---|---|
| EP | 0 877 309 Al | 11/1998 |
| EP | 0 881 357 A2 | 12/1998 |
| WO | WO 98/24010 | 6/1998 |
| WO | WO 00/31654 | 6/2000 |

OTHER PUBLICATIONS

"Application Of Neural Networks For Predictive Control In Drilling Dynamics," SPE 56442, Presented Oct. 1999.
"The Applications Of Advanced Computing Techniques To Oil And Gas Facility Optimisation," SPE 56904, Presented Sep. 1999.

* cited by examiner

*Primary Examiner*—David Bagnell
*Assistant Examiner*—Jennifer H. Gay
(74) *Attorney, Agent, or Firm*—Marlin R. Smith; J. Richard Konneker

(57) ABSTRACT

Methods are provided for downhole sensing and flow control utilizing neural networks. In a described embodiment, a temporary sensor is positioned downhole with a permanent sensor. Outputs of the temporary and permanent sensors are recorded as training data sets. A neural network is trained using the training data sets. When the temporary sensor is no longer present or no longer operational in the well, the neural network is capable of determining the temporary sensor's output in response to the input to the neural network of the permanent sensor's output.

45 Claims, 16 Drawing Sheets

DOWNHOLE SENSING AND FLOW CONTROL UTILIZING NEURAL NETWORKS

CROSS-REFERENCE TO RELATED APPLICATION

This application claims the benefit under 35 USC §119 of the filing date of PCT Application No. PCT/US01/05123, filed Feb. 16, 2001, the disclosure of which is incorporated herein by this reference.

TECHNICAL FIELD

The present invention relates generally to operations performed in conjunction with a subterranean well and, in an embodiment described herein, more particularly provides a method of sensing a parameter in a well.

BACKGROUND

It is quite advantageous to be able to use a sensor to sense a downhole parameter in a well environment. Such parameters may include pressure, temperature, resistivity, pH, dielectric, viscosity, flow rate, fluid composition, etc. This information enables a well operator to maintain efficient production from the well, plan future operations, comply with regulations, etc.

Unfortunately, many problems are encountered in sensing downhole parameters. Such problems include unavailability of a downhole sensor which senses the desired parameter, unavailability of a sensor which can withstand the well environment for an extended period of time, high cost of sensors which can withstand the well environment, short lifespan of downhole sensors, and unavailability of a high accuracy and/or resolution downhole sensor.

For example, a suitable sensor for a desired parameter may be available for use at the surface, but it may not be designed for downhole use. As another example, a sensor which otherwise meets all of the requirements for a downhole application may be prohibitively expensive. Yet another example is given by the situation in which a high accuracy and/or resolution downhole sensor for the desired parameter is available, but the sensor has a limited lifespan in the well environment, thereby making it unsuitable for long term use in the well.

Situations also arise in which a formerly operational downhole sensor becomes damaged, unable to communicate with the surface, or otherwise becomes unavailable for sensing the parameter in the well. In the past, these situations have required either that the sensor be replaced in a time-consuming and expensive operation, or that the well be produced without the benefit of the information obtained from the sensor. The latter option is very undesirable, since typically the information obtained from the sensor is used to efficiently produce the well, such as by properly adjusting flow control devices in the well based at least in part on the sensed parameter, etc.

SUMMARY

In carrying out the principles of the present invention, in accordance with an embodiment thereof, a method is provided which solves the above problems in the art. The method utilizes a neural network to determine at least one downhole parameter, even though a sensor for that parameter is not operational downhole at the time the parameter is determined.

In one aspect of the invention, a method is provided in which parameters for individual zones of a well are determined without having operational sensors for those parameters downhole when the parameters are determined. Training data sets are obtained using surface sensors, varied valve positions and temporary sensors. The neural network is trained using this data. The neural network is then used to determine the downhole parameters in response to inputting the surface sensors' outputs and the valve positions to the neural network.

In another aspect of the invention, a method is provided in which a sensor's output is determined, even after the sensor has failed. Training data sets from a time prior to the sensor's failure are obtained. The training data sets include outputs of other downhole sensors, varied valve positions, etc. The neural network is trained to output the failed sensors' output (before failure) in response to inputting the other sensor's outputs and the valve positions to the neural network.

In still another aspect of the invention, a method is provided in which a downhole parameter is determined, without using a permanent downhole sensor for that parameter. Training data sets are obtained using a temporary sensor for the desired parameter, and using other sensors for related parameters. The neural network is trained to produce the temporary sensor's outputs when the other sensors' outputs are input to the neural network. Thereafter, when the temporary sensor is no longer available for the desired parameter, the neural network will determine the temporary sensor's output in response to inputting the other sensors' outputs to the neural network.

In yet another aspect of the invention, a method is provided in which a high accuracy and/or resolution sensor is used to calibrate a lower accuracy and/or resolution sensor. The calibration sensor is temporarily installed in the well along with the permanent downhole sensor. Training data sets are obtained by recording outputs of both of the sensors in the well. The neural network is trained using this data, so that the neural network outputs the calibration sensor outputs in response to inputting the downhole sensor's outputs to the neural network. After the calibration sensor is no longer available, the downhole sensor's outputs are input to the neural network, which determines the corresponding outputs of the higher accuracy and/or resolution calibration sensor.

In a further aspect of the invention, methods are provided whereby a "virtual" sensor is created downhole. That is, the output of a nonexistent downhole sensor is determined in response to inputting the outputs of other sensors, etc., to a trained neural network. In one method, the neural network is trained using the outputs of a sensor temporarily in the well with the other sensors. In another method, the sensor capable of sensing a desired parameter remains at the surface when training data is obtained. In still another method, the sensor for the desired parameter and the other sensors are at the surface when the training data is obtained. In yet another method, a sensor is not used for the desired parameter, but known values for the desired parameter, along with the outputs of other sensors, are used to train the neural network.

In a still further aspect of the invention, a method is provided wherein a combination of downhole sensors and surface sensors are used. These sensors may be used with a temporary sensor to obtain training data for a neural network, and for inputting to the neural network after training and after the temporary sensor is not available. Other pertinent information, such as valve positions, choke sizes, etc. may also be used. Downhole sensors may be advantageously positioned away from a harsh well environment where it is desired to sense a parameter, but sufficiently far from the surface that the sensors are not within a surface temperature affected zone of the well.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
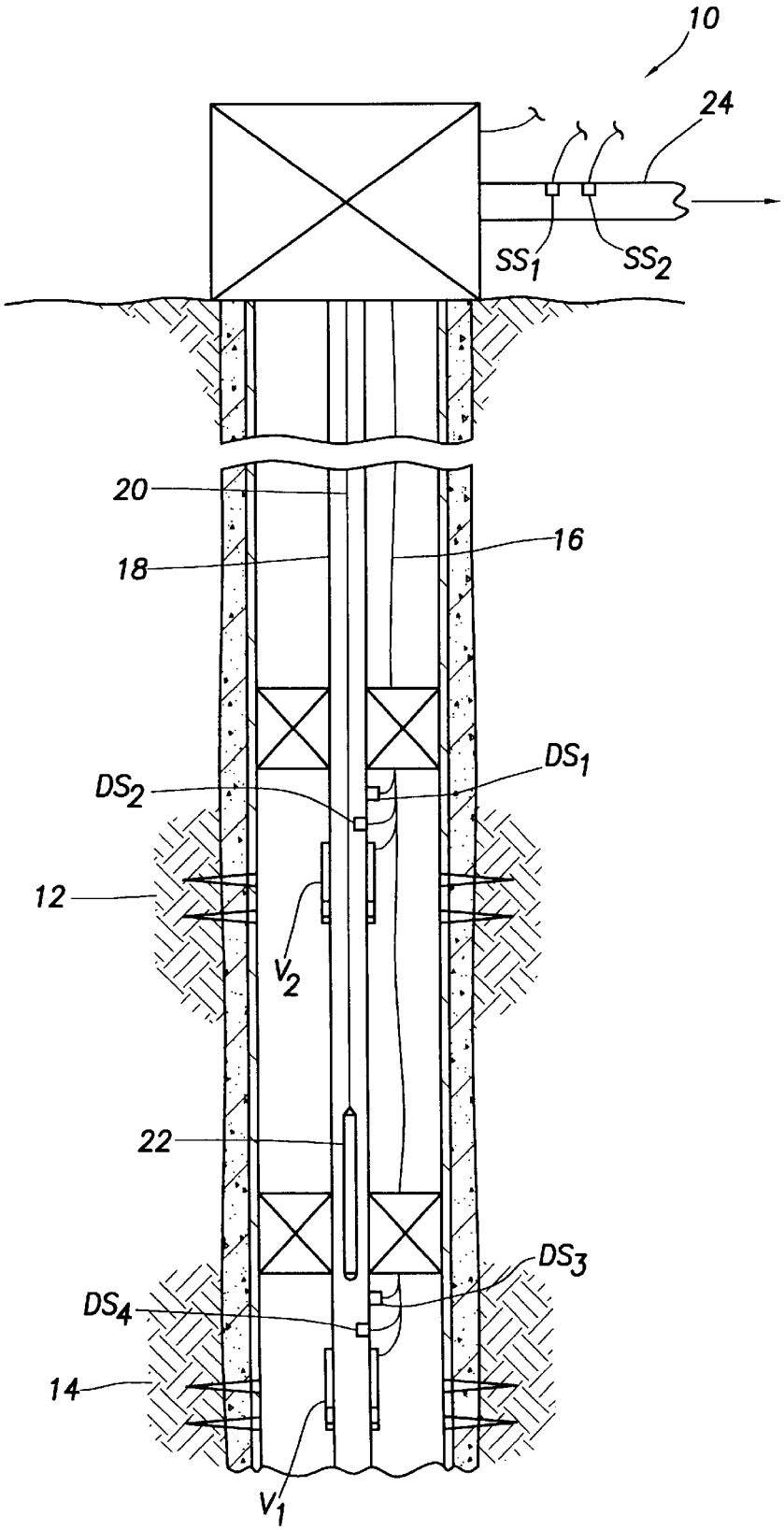
FIGS. 1–4 are schematic views of a first method embodying principles of the present invention.

Representatively illustrated in FIGS. 1–4 is a method 10 which embodies principles of the present invention. In the following description of the method 10 and other systems and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., in conjunction with various types of wells, including open hole, cased, production, injection, etc. wells, and in various configurations, without departing from the principles of the present invention.

In the method 10 as depicted in FIGS. 1–4, one or more parameters for multiple zones 12, 14 intersected by a well are initially measured by one or more temporary downhole sensors DS1, DS2, DS3, DS4. As used herein, the term "temporary" as used to describe a sensor means that the sensor is only temporarily present or operable in the well, as opposed to a sensor which is intended for long term or permanent use in a well. Preferably, in the method 10, the sensors DS1, DS2, DS3, DS4 are relatively inexpensive sensors but have expected short lifespans in the well environment. The expected short lifespans of the sensors DS1, DS2, DS3, DS4 may be due to the effects of downhole temperatures, downhole pressures and/or corrosive fluids, etc. on the sensors.

The sensors DS1, DS2, DS3, DS4 are used to obtain training data for a neural network 26 as described below. Lines 16 (which may be any type of lines, such as electrical, fiber optic, hydraulic, etc.) are connected to each of the sensors DS1, DS2, DS3, DS4 and extend to the earth's surface for communication of the sensors' outputs to a conventional computer system (not shown) for training the neural network using techniques well known to those skilled in the neural network training art. Of course, other techniques, such as acoustic or electromagnetic telemetry, etc., may be used to communicate the sensors' outputs, without departing from the principles of the present invention.

The sensors DS1, DS2, DS3, DS4 in the method 10 are each pressure and temperature sensors of the type well known to those skilled in the art. Sensors DS1 and DS3 sense pressure and temperature external to a production tubing string 18, and sensors DS2 and DS4 sense pressure and temperature internal to the tubing string. Sensors DS1 and DS2 sense these parameters proximate the zone 12, and sensors DS3 and DS4 sense these parameters proximate the zone 14.

Figure 2:
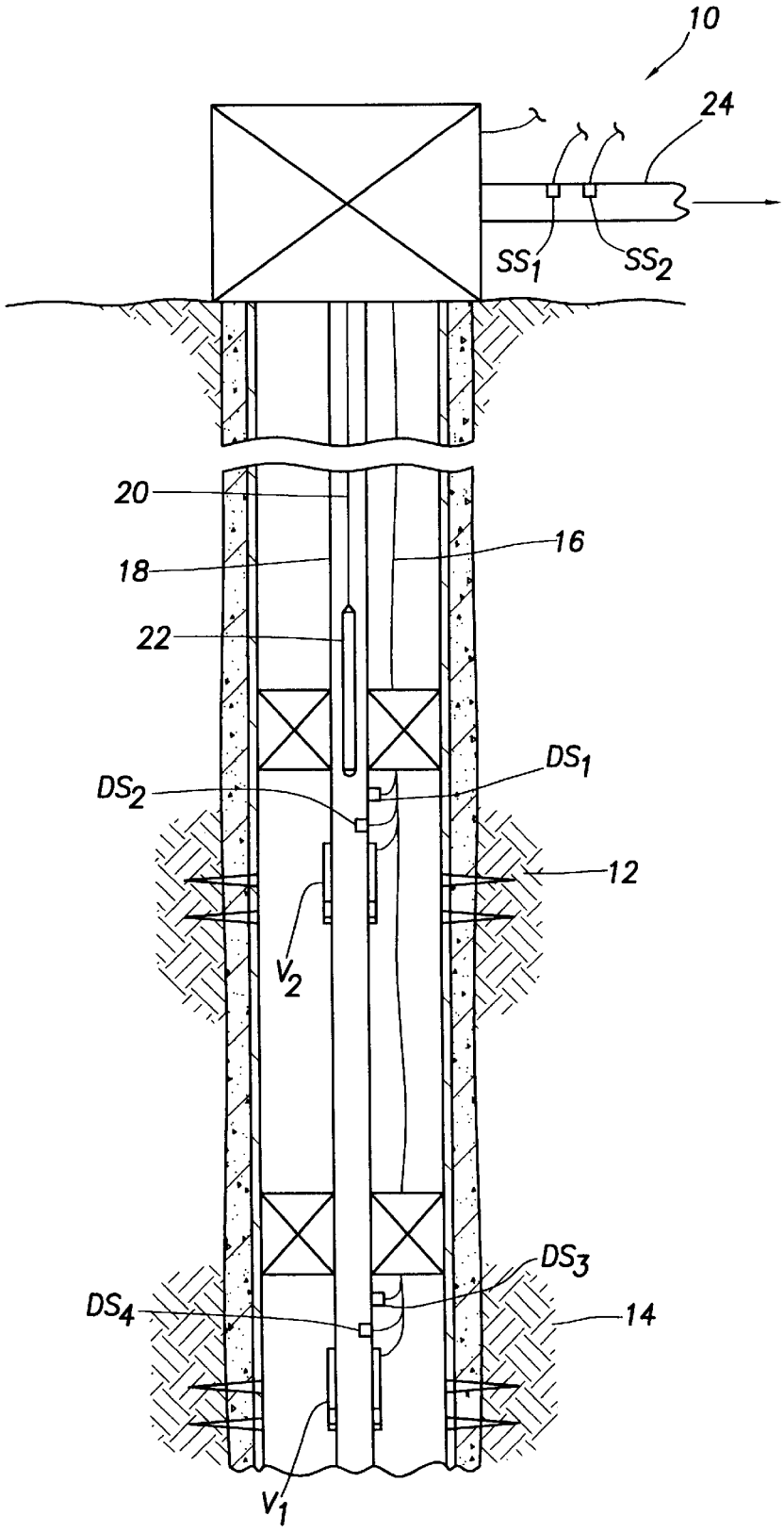

It will be readily appreciated that other types of sensors, other positionings of sensors and other types of temporary sensors may be used in the method 10. For example, sensors may be temporarily conveyed into the well suspended from a line 20, such as a wireline, electric line, slickline, etc. or coiled tubing, etc. as part of a logging tool 22. The tool 22 depicted in FIGS. 1 & 2 is a conventional production logging tool which typically includes at least pressure, temperature and flow rate sensors. Resistivity, density, viscosity, acceleration, pH, dielectric, or any other type of sensor may be used in the method 10.

The tool 22 may be positioned in the tubing string 18 above the zone 14 as shown in FIG. 1 for sensing parameters of fluid flowing into the tubing string via a valve V1 from the zone 14, and positioned above the zone 12 as shown in FIG. 2 for sensing parameters of fluid flowing into the tubing string via a valve V2 from the zone 12. Of course, fluid from the zones 12, 14 are commingled in the tubing string 18 when both of the valves V1, V2 are open, and the effects of this commingling on the outputs of the tool 22 sensors or on any of the sensors DS1, DS2, DS3, DS4 may be compensated for using techniques well known to those skilled in the art.

The valves V1, V2 are of the type which may be fully opened, fully closed or positioned therebetween to variably regulate fluid flow therethrough. Since the valves V1, V2 may be used to variably regulate flow, rather than just permit or prevent flow, they may be considered downhole chokes. However, it is to be clearly understood that any type of valve or choke may be used in the method 10, without departing from the principles of the present invention.

The valves V1, V2 are also of the type for which the positions thereof may be known to an operator at the surface. For example, the valves V1, V2 may include position sensors (not shown) connected to the lines 16, or a particular pressure applied to certain of the lines 16 may cause hydraulic actuators (not shown) of the valves to position the valves in a known manner, or a conventional shifting tool (not shown) may be used to position the valves in known positions, etc. Thus, it will be appreciated that any technique may be used to actuate the valves V1, V2 and to know the valves' positions.

Sensors SS1, SS2 are installed in a production flowline 24 at the surface. The surface sensors SS1, SS2 are preferably permanent sensors, meaning that they are installed at the well for long term use. However, since the surface sensors SS1, SS2 are readily accessible, they may alternatively be temporary sensors, in keeping with the principles of the present invention.

The sensors SS1, SS2 may be any type of sensors. For example, the surface sensor SS1 may be a pressure and temperature sensor, and the surface sensor SS2 may be a flow rate sensor. These sensors SS1, SS2 are also connected to the computer system (not shown) described above for training the neural network, and for long term monitoring of production from the zones 12, 14 after the neural network has been trained, as described below.

Figure 3:
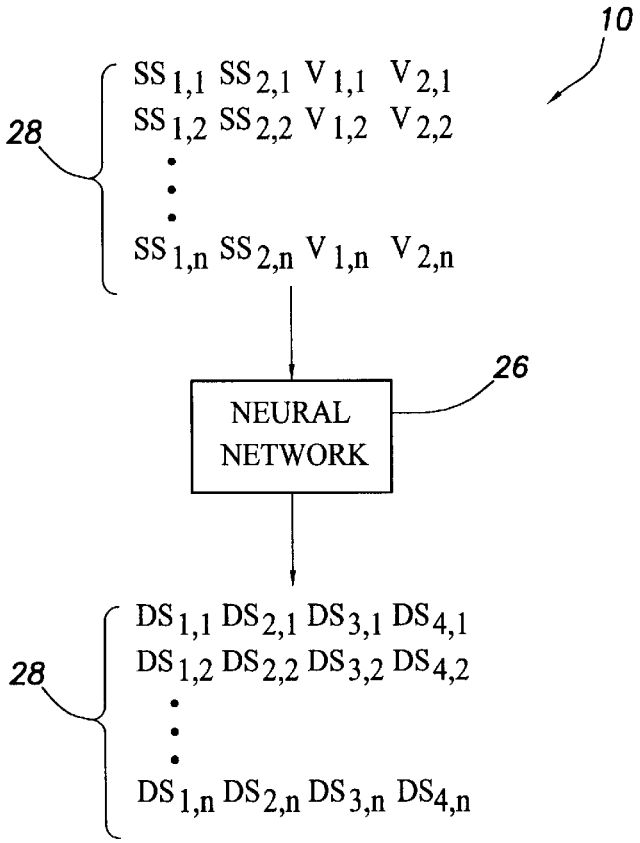

Turning now to FIG. 3, a neural network training step of the method 10 is representatively illustrated. The neural network 26 is trained using multiple training data sets 28 comprising outputs of the surface sensors SS1, SS2, outputs of the downhole sensors DS1, DS2, DS3, DS4 and positions of the valves V1, V2. In the method 10, the valves V1, V2 are placed in various positions (fully open, fully closed, partially open, etc.) and the outputs of the various sensors SS1, SS2, DS1, DS2, DS3, DS4 are recorded.

In FIG. 3, the first training data set includes the first position of valve V1 (depicted as V1,1), the first position of valve V2 (depicted as V2,1), the corresponding outputs of surface sensors SS1, SS2 (depicted as SS1,1 and SS2,1, respectively) and the corresponding outputs of the downhole sensors DS1, DS2, DS3, DS4 (depicted as DS1,1, DS2,1, DS3,1 and DS4,1, respectively). That is, the first training data set includes the first positions of the valves V1, V2 (positions V1,1 and V2,1) and the outputs of the sensors SS1, SS2, DS1, DS2, DS3, DS4 while the valves are in those positions (sensor outputs SS1,1, SS2,1, DS1,1, DS2,1, DS3,1 and DS4,1). There are n total training data sets, with training data sets subsequent to the first being depicted in FIG. 3 and numbered similarly to the first training data set described above.

In the neural network 26 training step, the surface sensor outputs SS1,1 . . . n, SS2,1 . . . n and the valve positions V1,1 . . . n, V2,1 . . . n are input to the neural network, and the neural network is trained to output the respective downhole sensor outputs DS1,1 . . . n, DS2,1 . . . n, DS3,1 . . . n, DS4,1 . . . n. That is, the neural network 26 when successfully trained outputs the downhole sensor outputs of a particular training data set (within an acceptable margin of error) when the surface sensor outputs and valve positions of that training data set are input to the neural network.

The neural network 26 may be any of the wide variety of neural networks known to those skilled in the art. Furthermore, any technique known to those skilled in the art for training the neural network 26 may be used. For example, the neural network 26 may be a perceptron network, Hopfield network, Kohonen network, etc., and the training technique may utilize a back propagation algorithm, or one of the special algorithms used to train Hopfield and Kohonen networks, etc. The neural network 26 may take any form, for example, it may be "virtual" in that it exists in a computer memory or in computer readable form and may be manipulated using computer software, or the neural network may be a physical network of electronic components, etc. In addition, any techniques may be used to refine or optimize the neural network 26 training, such as by using tapped delay lines (not shown), etc.

It will be readily appreciated by one skilled in the art that the trained neural network 26 is of significant value in monitoring production from the zones 12, 14. This is due to the fact that the trained neural network 26 is capable of generating the downhole sensors' outputs given only the surface sensors' outputs and the valves' positions.

Figure 4:
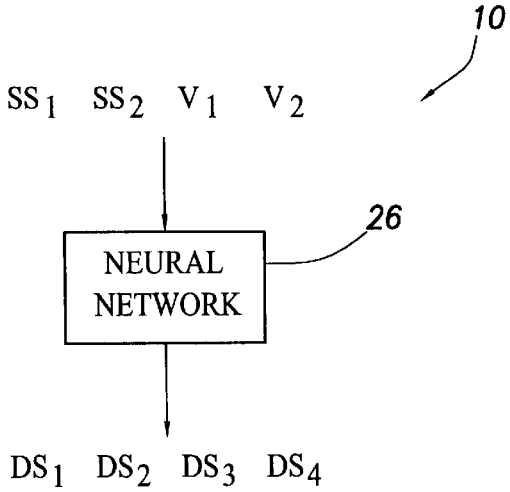

Turning now to FIG. 4, the neural network 26 is shown in operation in the method 10, after the neural network has been trained. The surface sensor outputs (depicted in FIG. 4 as SS1 and SS2) and the valve positions (depicted in FIG. 4 as V1 and V2) are input to the neural network 26. In response, the neural network 26 outputs the downhole sensor outputs (depicted in FIG. 4 as DS1, DS2, DS3 and DS4), which the neural network is able to determine based on its training.

Thus, if one or more of the downhole sensors DS1, DS2, DS3, DS4 becomes inoperative or is no longer present in the well, the neural network 26 is still able to determine the output(s) of the inoperative sensor(s). In actual practice, this permits the installation of inexpensive or less desirable short lived sensors as temporary sensors in a well for obtaining neural network training data, while more expensive permanent sensors are used at the surface for long term monitoring of the well, even after the downhole sensors have become inoperative or are no longer present in the well (such as after a wireline conveyed production logging tool has been removed from the well).

Another benefit of the method 10 is that it permits long term monitoring of the well using sensors installed at the surface, where they are readily accessible for maintenance, replacement, calibration, etc., after relatively inaccessible downhole sensors have become inoperative, or after the downhole sensors are no longer present in the well. Yet another benefit of the method 10 is that it permits analysis of factors affecting production of the well. For example, after the neural network 26 is trained, prospective values for certain variables may be input to the neural network to determine their effect on the neural network outputs. The position of the valve V1 input to the neural network 26 may be changed, for example, to see how the change will affect the outputs of the downhole sensors DS1, DS2, DS3, DS4. The method 10, therefore, enables flow control in the well to be performed based on a predetermination of its effect on downhole parameters.

Figure 5:
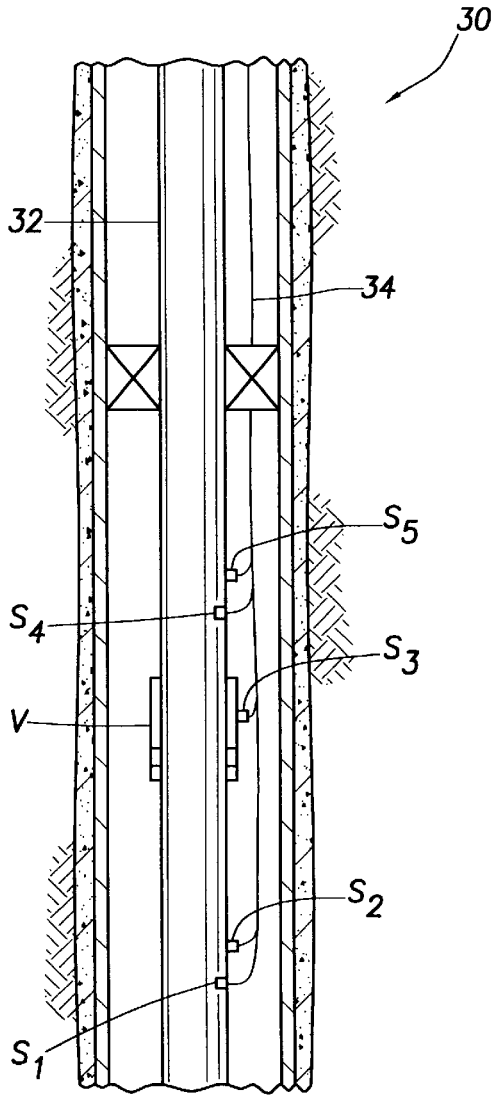
FIGS. 5–7 are schematic views of a second method embodying principles of the present invention.
Figure 6:
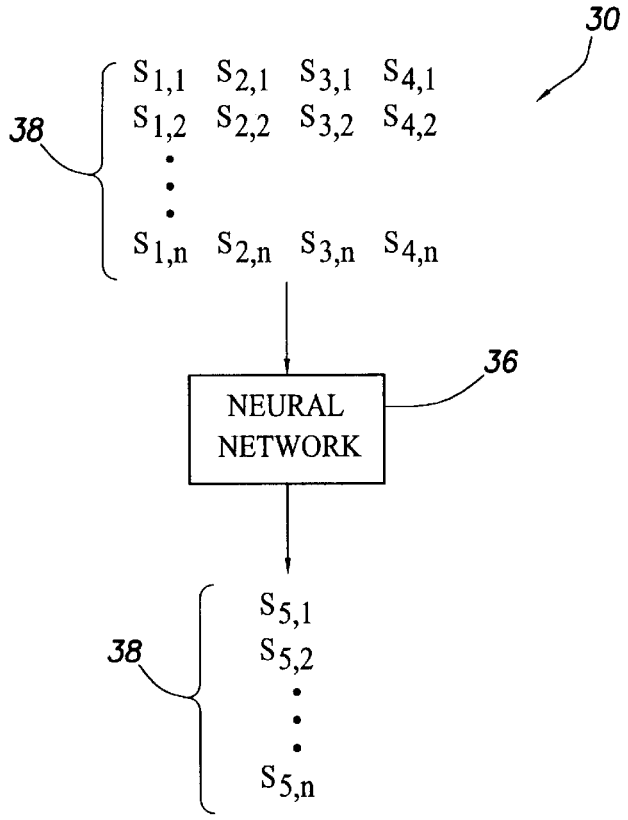
Figure 7:
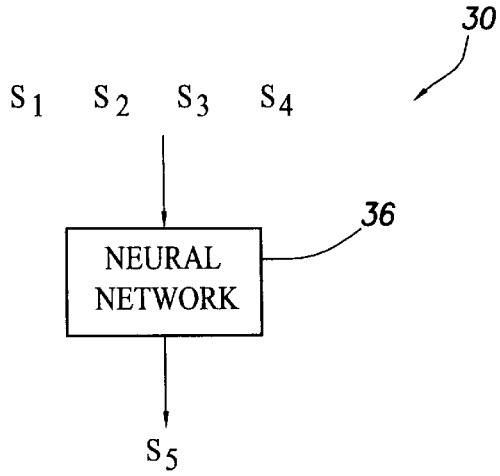

Referring additionally now to FIGS. 5–7, another method 30 embodying principles of the present invention is representatively illustrated. The method 30 is similar to the method 10 described above in many respects, specifically, in that the output of a sensor is determined by a neural network after that sensor becomes inoperative, or is no longer present in a well. However, the method 30 does not utilize temporary sensors as such.

Instead, in the method 30, multiple sensors S1, S2, S3, S4, S5 are installed in the well, and all of the sensors may initially be intended to be installed permanently in the well. As depicted in FIG. 5, sensors S1 and S4 are, for example, pressure and temperature sensors in communication with the interior of a tubing string 32, sensors S2 and S5 are, for example, pressure and temperature sensors in communication with the exterior of the tubing string, and the sensor S3 is a position sensor for indicating a position of a valve V in the tubing string. Of course, any types of sensors, any combination of sensor types, any number of sensors, etc., may be used in a method embodying principles of the present invention.

Outputs of the sensors S1, S2, S3, S4, S5 are transmitted to a computer system (not shown) via lines 34. Any type of lines may be used for the lines 34, and other communication means, such as acoustic telemetry, etc., may be used in place of the lines.

The method 30 permits the output of one or more of the sensors S1, S2, S3, S4, S5 to be determined, even after that sensor becomes inoperative or is no longer present in the well. For example, if the sensor S5 becomes inoperative, data obtained from when the sensor was operative may be used to train a neural network 36 to determine the sensor's output after it becomes inoperative.

Specifically, using the example of an inoperative sensor S5, training data sets 38 are obtained from a period of time in which the sensor was operative (see FIG. 6). The training data sets 38 each include corresponding outputs of all of the sensors S1, S2, S3, S4, S5. For example, a first training data set includes corresponding outputs of the sensors S1, S2, S3, S4, S5 (depicted in FIG. 6 as S1,1, S2,1, S3,1, S4,1, S5,1), a second training data set includes corresponding outputs of the sensors (depicted in FIG. 6 as S1,2, S2,2, S3,2, S4,2, S5,2), etc., up to a total of n training data sets.

The neural network 36 is trained to output the sensor S5 outputs corresponding to outputs of the sensors S1, S2, S3, S4 input to the neural network. That is, the neural network 36 will, after training, produce the sensor S5 output of a particular training data set when the corresponding outputs of the other sensors S1, S2, S3, S4 in the training data set are input to the neural network (with an acceptable margin of error). Any type of neural network may be used for the neural network 36, and the neural network may be trained and optimized using any known methods.

After the neural network 36 has been trained, and the sensor S5 has become inoperative, its output has become unavailable or the sensor is no longer present in the well, etc., the neural network may be used to determine the sensor's output based on the outputs of the remaining sensors S1, S2, S3, S4. This result is accomplished by inputting the remaining sensor outputs (depicted in FIG. 7 as S1, S2, S3, S4) to the neural network 36, and the neural network in response determining the inoperative sensor's output (depicted in FIG. 7 as S5).

It will be readily appreciated that the method 30 permits the loss of a sensor to be compensated for in the situation where a history of the sensor's outputs, and outputs of other sensors, are available from a time prior to the sensor's loss. Use of the method 30 will typically be far more cost effective than retrieving and replacing the lost sensor. Note that the exclusive use of sensor outputs other than those of the sensor S5 to train the neural network 36 is not necessary, since other parameters such as valve positions known other than via a sensor (as in the method 10 described above), etc., may be used instead of, or in addition to, the other sensor outputs to train the neural network.

Referring additionally now to FIGS. 8–11, another method 40 embodying principles of the present invention is representatively illustrated. The method 40 is similar in many respects to the methods 10, 30 described above, in that a neural network 42 is trained to determine the output of a sensor after that sensor is no longer present in a well. In the example depicted in FIGS. 8–11, the output of a flow rate sensor is determined after the sensor is retrieved from the well, but it is to be clearly understood that the method 40 may be utilized for other types of sensors, other numbers of sensors, combinations of sensors, etc., without departing from the principles of the present invention. Elements shown in FIGS. 8 & 9 which are similar to those shown in FIGS. 1 & 2 are indicated using the same reference numbers.

Figure 8:
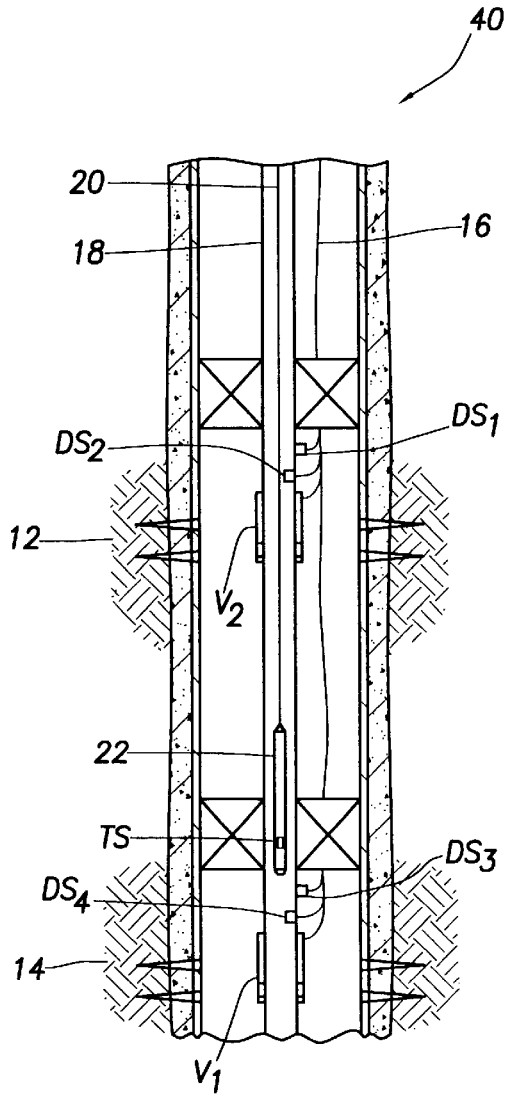
FIGS. 8–11 are schematic views of a third method embodying principles of the present invention.

As illustrated in FIG. 8, sensors DS1, DS2, DS3, DS4 are installed in the well as part of the tubing string 18. Valves V1, V2 permit fluid production from zones 12, 14 intersected by the well. The positions of the valves V1, V2 are known, either by use of a sensor, such as a position sensor (not shown), or by another method.

The production logging tool 22 is used as a temporary sensor to obtain multiple training data sets for training the neural network 42. For example, with the logging tool 22 positioned above the valve V1 as shown in FIG. 8, training data sets 44 are obtained with the valves V1, V2 in various positions. The training data sets 44 include corresponding outputs of the sensors DS1, DS2, DS3, DS4, positions of the valves V1, V2, and outputs of the logging tool flow rate sensor (depicted in FIG. 10 as TS) for a total of n data sets.

The neural network 42 is trained to output corresponding outputs of the temporary flow rate sensor TS in response to inputting to the neural network the outputs of the sensors DS1, DS2, DS3, DS4 and positions of the valves V1, V2. That is, the neural network 42 will, after training, produce the flow rate sensor TS output of a particular training data set when the corresponding outputs of the other sensors DS1, DS2, DS3, DS4 and positions of the valves V1, V2 in the training data set are input to the neural network (with an acceptable margin of error). Any type of neural network may be used for the neural network 42, and the neural network may be trained and optimized using any known methods.

After the neural network 42 has been trained and the logging tool 22 has been retrieved from the well, the flow rate through the tubing string 18 above the valve V1 may be determined by inputting to the neural network the outputs of the sensors DS1, DS2, DS3, DS4 and positions of the valves V1, V2. This step is representatively illustrated in FIG. 11. The neural network 42 in response will determine what the output of the flow rate sensor TS would be if it were present in the tubing string 18 above the valve V1 as depicted in FIG. 8.

It will be readily appreciated that the method 40 in a sense creates a "virtual" sensor to take the place of the flow rate sensor TS after it has been retrieved from the well. This is very beneficial in situations where, for example, it is undesirable to have a flow rate sensor obstructing the interior of the tubing string 18 during normal production operations. The neural network 42 determines the "virtual" flow rate sensor output based on the outputs of the other downhole sensors DS1, DS2, DS3, DS4 and the corresponding positions of the valves V1, V2.

Figure 9:
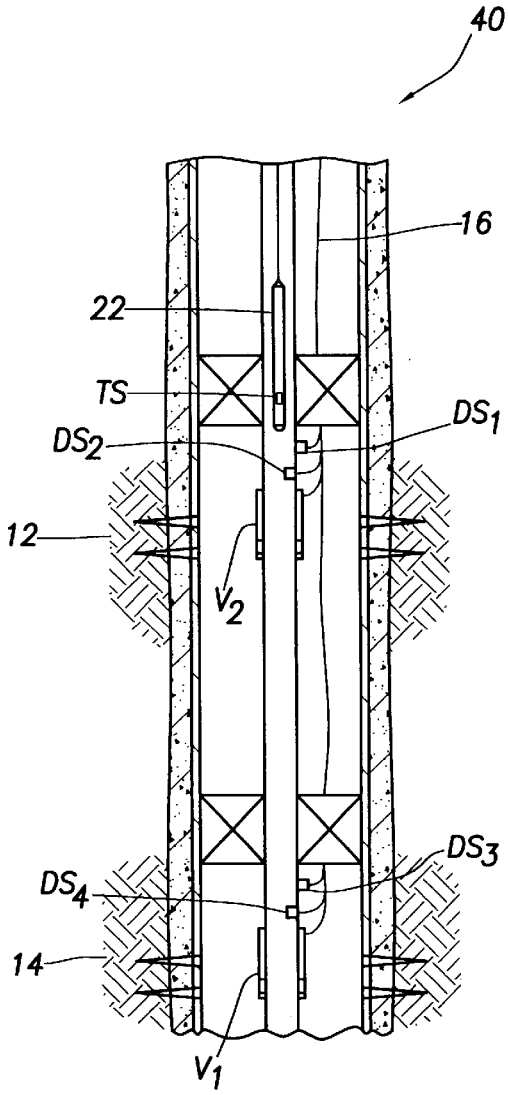

A similar neural network may be used for determining the output of the flow rate sensor TS positioned above the valve V2 as depicted in FIG. 9. In that case, the neural network would be trained as described above for the neural network 42, Using the flow rate sensor TS outputs at the position above the valve V2 in place of the flow rate sensor TS outputs at the position above the valve V1. Of course, the rate of fluid flow through the tubing string 18 above the valve V2 will include contributions from both of the zones 12, 14 if both of the valves V1, V2 are open, however, conventional techniques may be used to calculate individual flow rates from the individual zones using the outputs of the neural networks. Thus, it may be seen that the method 40 permits multiple "virtual" sensors to be created at various positions in the well.

Figure 12:
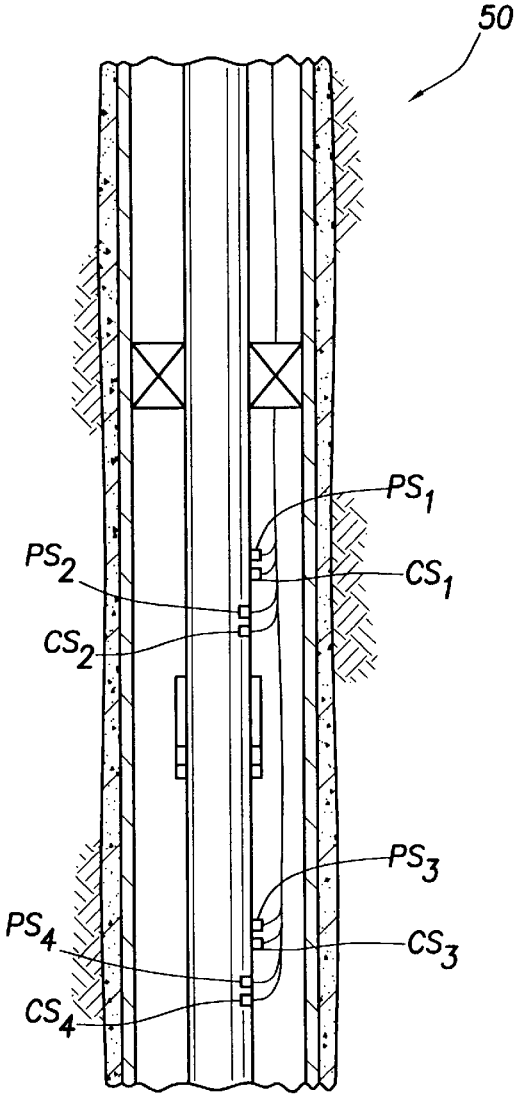
FIGS. 12–14 are schematic views of a fourth method embodying principles of the present invention.
Figure 10:
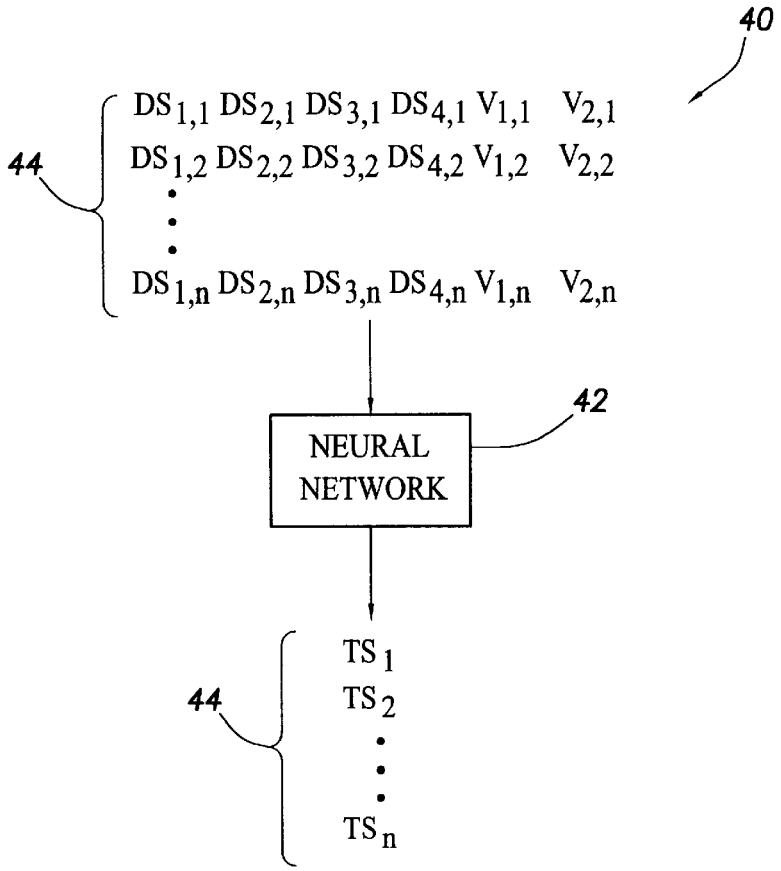
Figure 11:
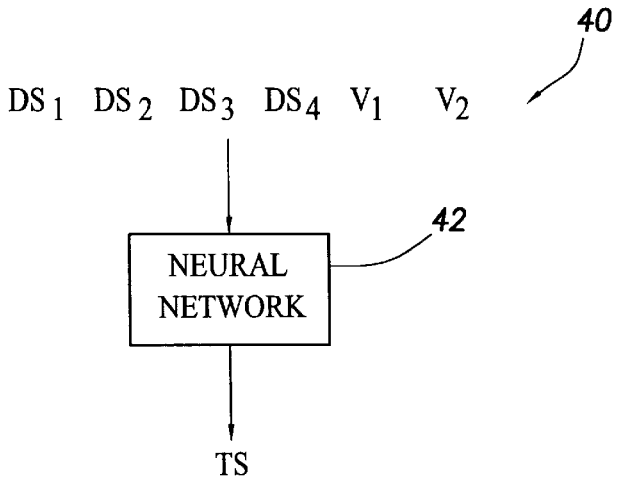
Figure 13:
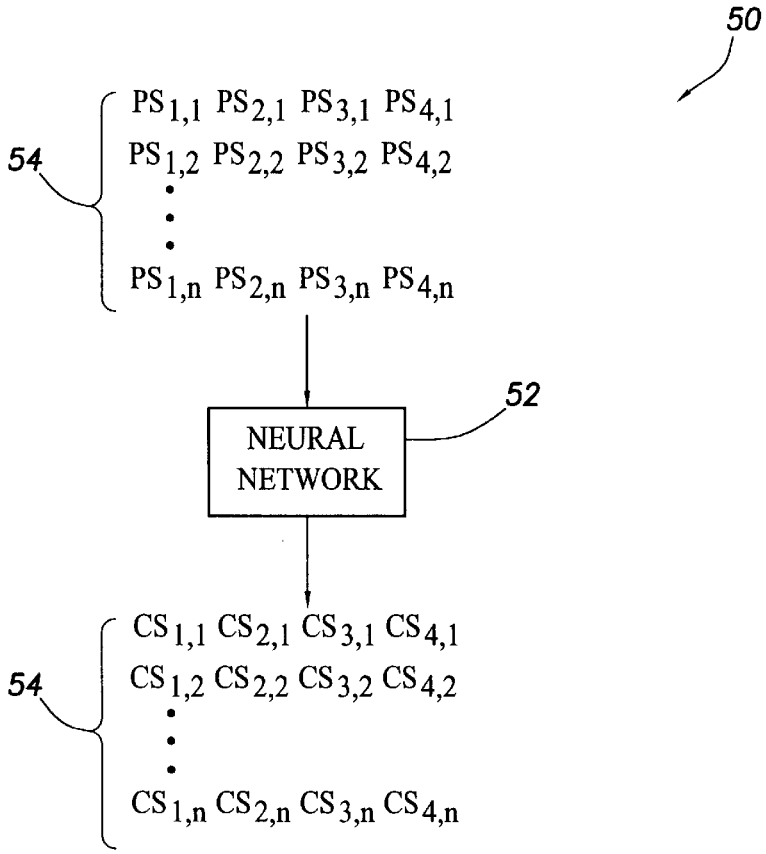
Figure 14:
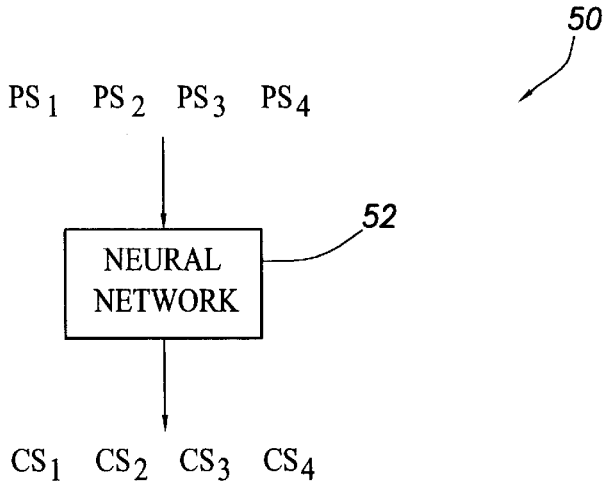

Referring additionally now to FIGS. 12–14, another method 50 embodying principles of the present invention is representatively illustrated. The method 50 is similar in many respects to the methods 10, 40 described above, in that a neural network 52 is used in conjunction with a temporary sensor and a permanent sensor. However, in the method 50, the temporary sensor is used for calibration or enhancement of the output of the permanent sensor.

As depicted in FIG. 12, permanent sensors PS1, PS2, PS3, PS4 are installed in a well. The permanent sensors PS1, PS2, PS3, PS4 may, for example, be pressure and temperature sensors. Of course, any other type of sensors, any combination of sensors, etc., may be used a method incorporating principles of the present invention.

The permanent sensors PS1, PS2, PS3, PS4 may, when used alone, have less accuracy and/or resolution than is desired. However, more desirable sensors may not be able to withstand the downhole environment for an extended period of time. The method 50 resolves this problem by using more accurate and/or higher resolution calibration sensors CS1, CS2, CS3, CS4 to calibrate the permanent sensors PS1, PS2, PS3, PS4 downhole while the calibration sensors remain operative in the well. The outputs of the calibration and permanent sensors are used to train the neural network 52. After the calibration sensors CS1, CS2, CS3, CS4 become inoperative, the trained neural network 52 determines what the outputs of the higher accuracy and/or resolution calibration sensors would be, based on the outputs of the lower accuracy and/or resolution permanent sensors.

As depicted in FIG. 13, the neural network 52 is trained using multiple training data sets 54 obtained while the calibration sensors CS1, CS2, CS3, CS4 remain operative in the well. Specifically, the training data sets 54 each include corresponding outputs of the calibration sensors CS1, CS2, CS3, CS4 and outputs of the permanent sensors PS1, PS2, PS3, PS4. The neural network 52 is trained so that it outputs the calibration sensor outputs of a particular training data set when corresponding permanent sensor outputs of the training data set are input to the neural network. Any type of neural network may be used for the neural network 52, and the neural network may be trained and optimized using any known methods.

After the calibration sensors CS1, CS2, CS3, CS4 are no longer operative, outputs of the permanent sensors PS1, PS2, PS3, PS4 are input to the neural network 52 as depicted in FIG. 14. In response, the neural network 52 determines the corresponding outputs of the calibration sensors CS1, CS2, CS3, CS4. Thus, the higher accuracy and/or resolution calibration sensor outputs may be determined from the lower accuracy and/or resolution permanent sensor outputs, even after the calibration sensors CS1, CS2, CS3, CS4 are no longer operative in the well.

Thus, it is not necessary to develop or purchase expensive sensors which are both highly accurate and capable of withstanding severe well environments for permanent installation in a well. Instead, using the method 50, the outputs of less accurate sensors, which can withstand severe well environments, obtain the benefit of the outputs of more accurate, but short-lived, sensors by use of the neural network 52.

Figure 15:
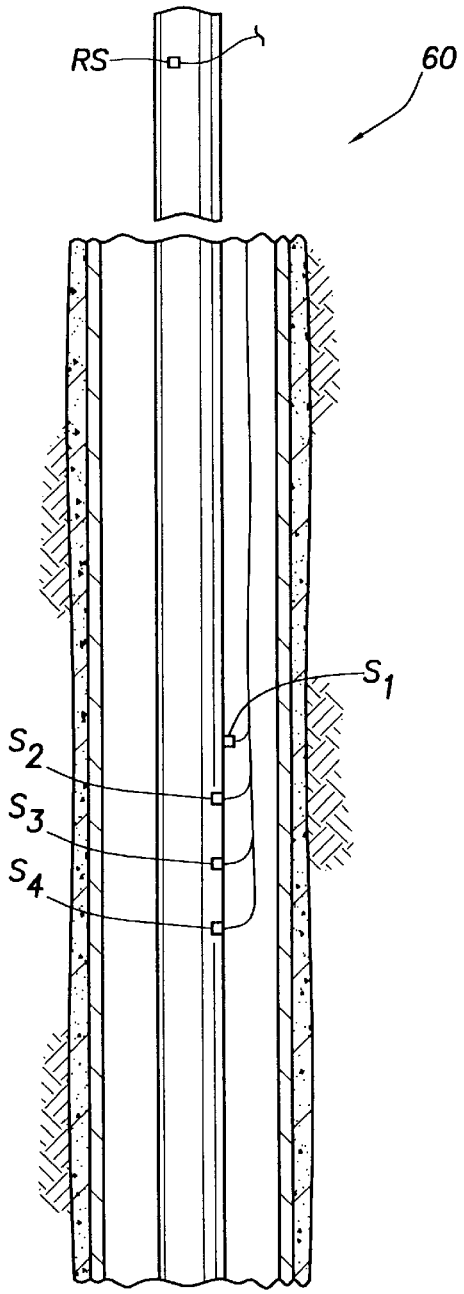
FIGS. 15–17 are schematic views of a fifth method embodying principles of the present invention.
Figure 16:
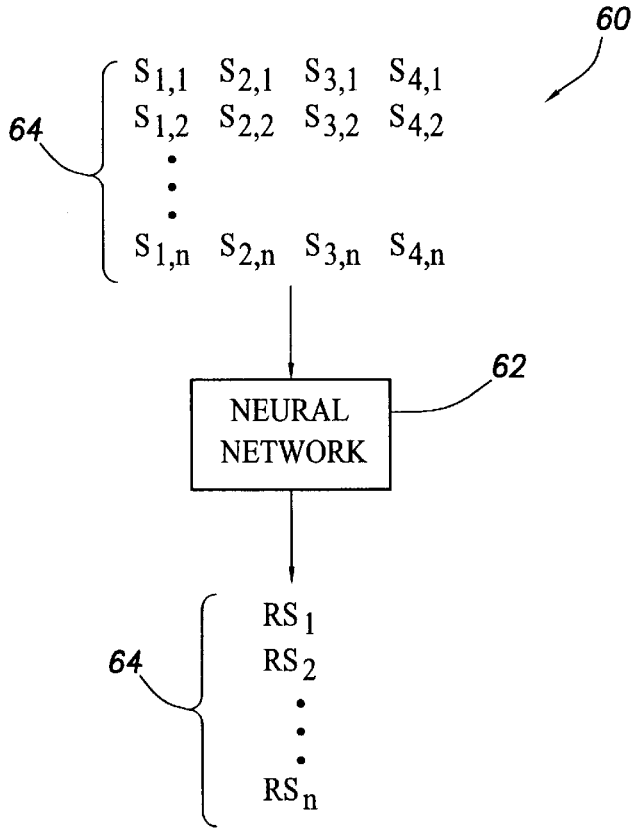
Figure 17:
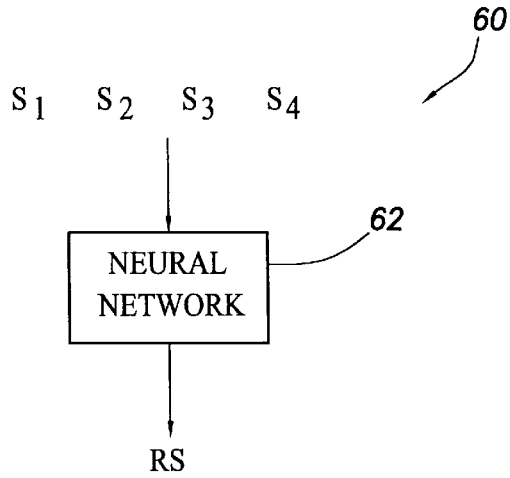

Referring additionally now to FIGS. 15–17, another method 60 embodying principles of the present invention is representatively illustrated. The method 60 differs from the above methods 10, 30, 40, 50 in at least one substantial aspect in that a temporary downhole sensor is not used in training a neural network. Instead, a reference sensor is used at the surface, in conjunction with outputs from sensors to be used downhole, to train the neural network. The method 60 is especially useful in those situations where a downhole sensor for sensing a particular downhole parameter either does not exist, is not suitable for a particular application, is prohibitively expensive, etc.

Where, however, a reference sensor RS exists for sensing the parameter at the surface, this reference sensor may be used in the method 60 to train a neural network 62. With the reference sensor RS at the surface and various downhole sensors S1, S2, S3, S4 in the well, multiple training data sets are obtained. The training data sets 64 include outputs of the reference sensor RS and corresponding outputs of the other sensors S1, S2, S3, S4.

Preferably, the sensors S1, S2, S3, S4 sense parameters related to the downhole parameter which is sensed by the reference sensor RS. For example, if the reference sensor RS is a flow rate sensor, the other sensors S1, S2, S3, S4 may be pressure and temperature sensors, viscosity sensors, etc. However, it is to be clearly understood that any type of sensor may be used for the reference sensor RS, the reference sensor could be multiple sensors, and any type of sensors and combination of sensors may be used for the downhole sensors.

Turning now to FIG. 16, the neural network 62 is trained to output the corresponding output of the reference sensor RS (with an acceptable margin of error) when the outputs of the downhole sensors S1, S2, S3, S4 are input to the neural network. That is, the neural network 62 when trained outputs a reference sensor RS output of a particular training data set when the corresponding downhole sensor S1, S2, S3, S4 outputs of the training data set are input to the neural network. Any type of neural network may be used for the neural network 62, and the neural network may be trained and optimized using any known methods.

After the neural network 62 is trained, outputs of the downhole sensors S1, S2, S3, S4 are then input to the neural network 62. The neural network 62 in response determines an output of the reference sensor RS as depicted in FIG. 17.

Thus, the method 60 permits the output of a reference sensor to be determined by a neural network, given the outputs of downhole sensors, even though the reference sensor has not been downhole to obtain training data sets for training the neural network. The method 60 in a sense creates a "virtual" sensor for the particular downhole parameter which it is desired to sense.

Figure 18:
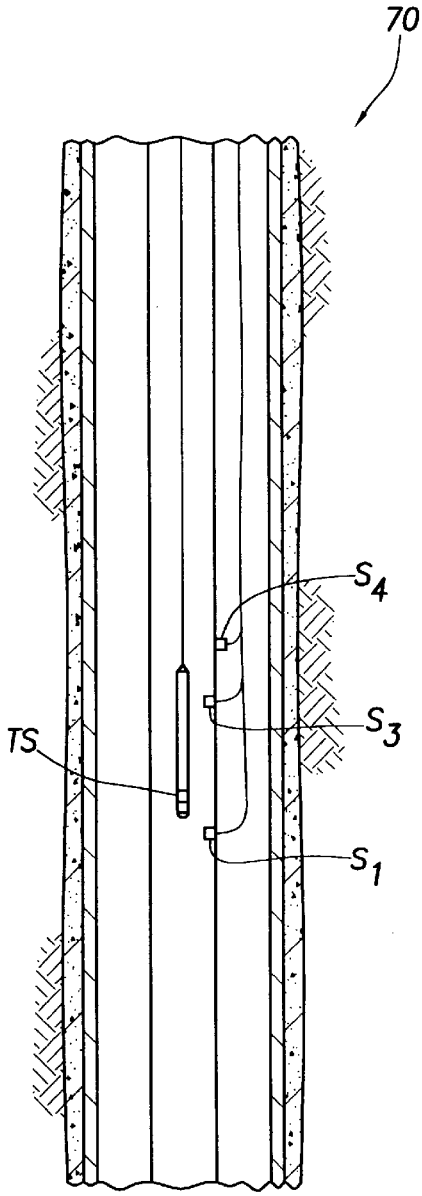
FIGS. 18–20 are schematic views of a sixth method embodying principles of the present invention.
Figure 19:
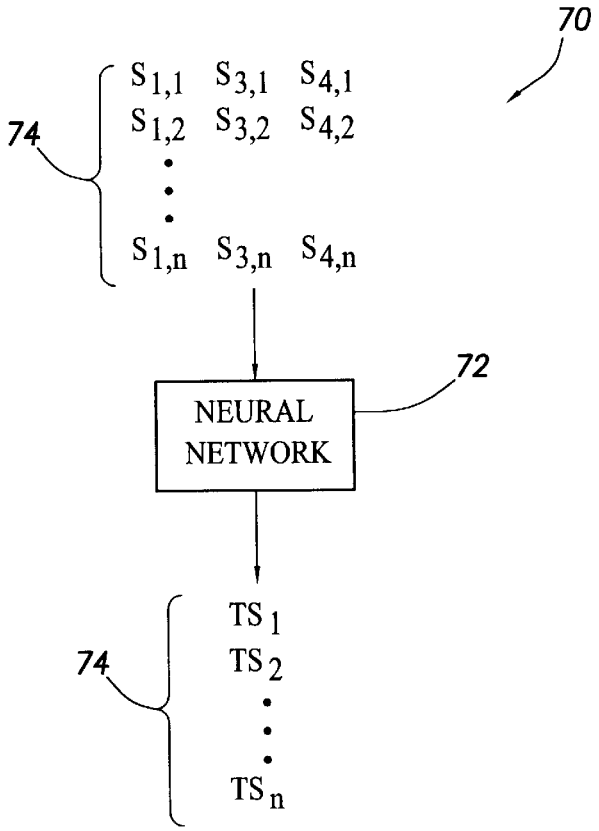
Figure 20:
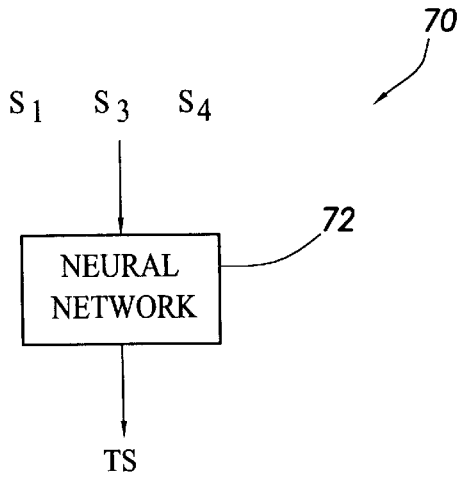

Referring additionally now to FIGS. 18–20, another method 70 embodying principles of the present invention is representatively illustrated. The method 70 is similar in many respects to the method 60 described above, but differs significantly in at least one respect in that a reference sensor at the surface is not used to obtain training data sets. Instead, the method 70 utilizes a temporary sensor TS which is only temporarily present in the well.

The temporary sensor TS may be conveyed into the well by wireline, electric line, slickline, coiled tubing, or any other conveyance. While the temporary sensor TS is present in the well, a particular downhole parameter is sensed by the temporary sensor. Other downhole sensors S1, S3, S4 are installed in the well and preferably sense parameters which are related to the parameter sensed by the temporary sensor TS.

Multiple training data sets 74 are obtained by recording outputs of the temporary sensor TS and corresponding outputs of the downhole sensors S1, S3, S4. The training data sets 74 are obtained with the sensors TS, S1, S3, S4 downhole.

The neural network 72 is then trained to output the temporary sensor TS output when outputs of the downhole sensors S1, S3, S4 are input to the neural network, as depicted in FIG. 19. That is, the trained neural network 72 will output an output of the temporary sensor TS of a particular training data set when the corresponding outputs of the downhole sensors S1, S3, S4 are input to the neural network. Any type of neural network may be used for the neural network 62, and the neural network may be trained and optimized using any known methods.

As depicted in FIG. 20, after the neural network 72 is trained, outputs of the downhole sensors S1, S3, S4 are input to the neural network. In response, the neural network 72 determines the output of the temporary sensor TS, even though the temporary sensor may no longer be present in the well. Thus, the method 70 in a sense creates a "virtual" sensor downhole to take the place of the temporary sensor TS.

Figure 21:
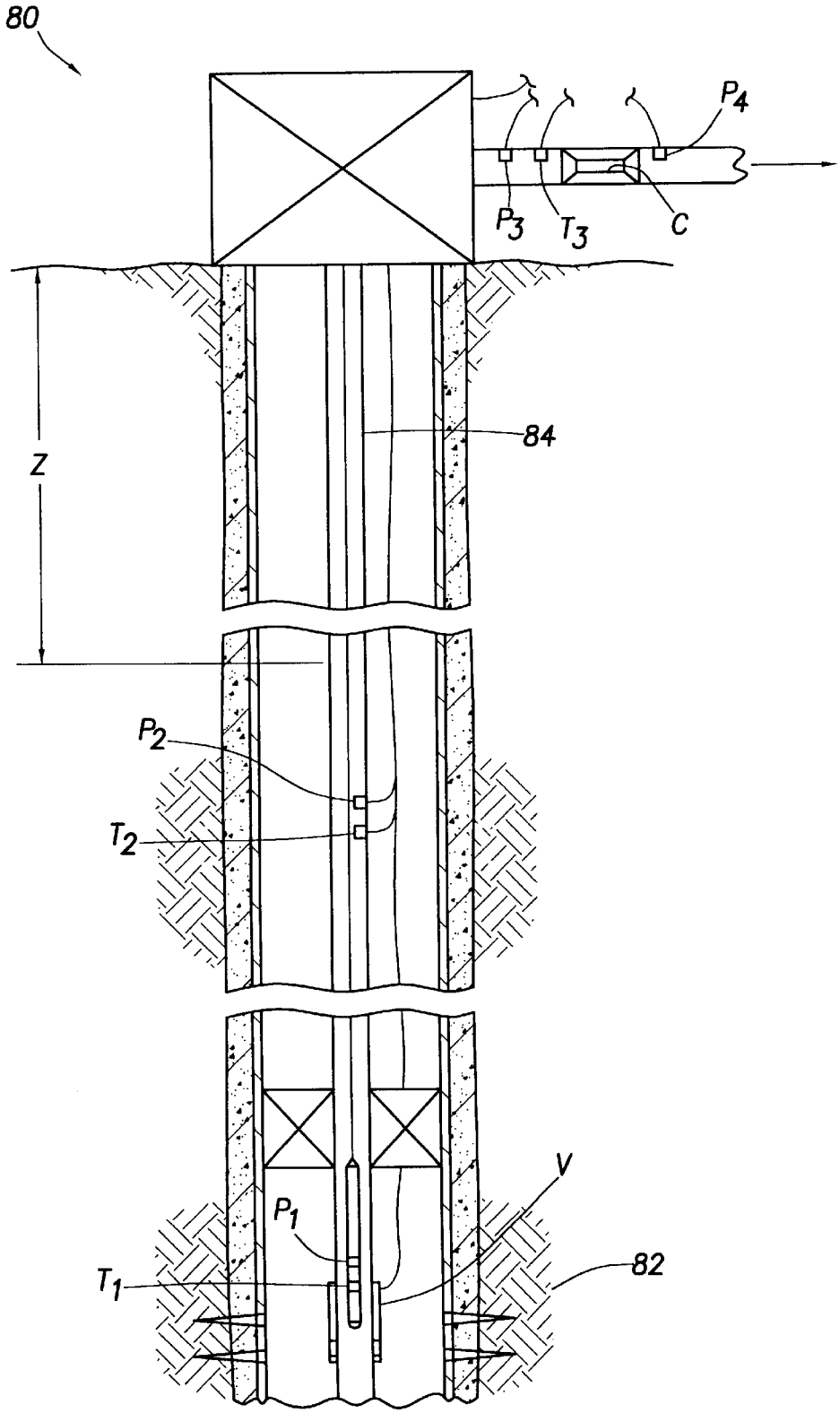
FIGS. 21–23 are schematic views of a seventh method embodying principles of the present invention.
Figure 22:
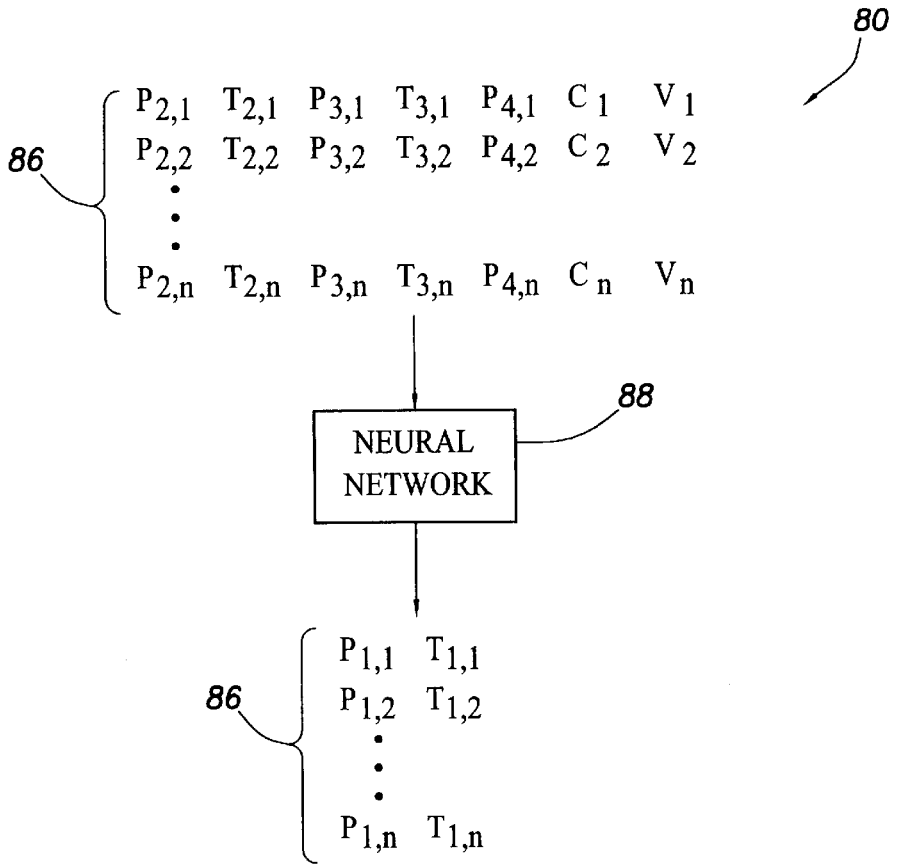
Figure 23:
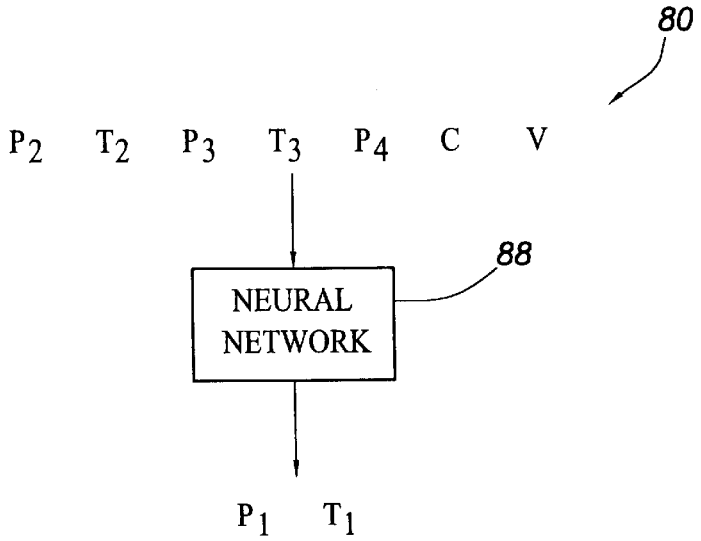

Referring additionally now to FIGS. 21–23, another method 80 embodying principles of the present invention is representatively illustrated. The method 80 provides another means by which a "virtual" sensor may be created. In this method, however, sensors which sense the desired or related parameters of interest cannot withstand the downhole environment at the location where sensing is desired for a long period of time. For example, the pressure and temperature at a producing zone may be desired, but sensors which can withstand the pressure and temperature at the producing zone may not be available for long term use in the well, such sensors may be prohibitively expensive, etc.

Specifically, as depicted in FIG. 21, the well intersects a zone 82 and a valve V is used to control flow between the zone and the interior of a production tubing string 84. The valve V may have a position sensor, or its position may be otherwise known.

Sensors P1, T1 are temporarily conveyed into the well, for example, as part of a wireline, slickline or coiled tubing conveyed tool. The sensors P1, T1 may be positioned proximate the zone 82 for only so long as it takes to record a sufficient number of training data sets, as described below. Alternatively, the sensors P1, T1 may be permanently installed in the tubing string 84 proximate the zone 82, but may only be able to withstand the well environment at that position for a limited period of time.

Other pressure and temperature sensors P2, T2 are installed in the well, but they are not proximate the zone 82. Instead, the sensors P2, T2 are positioned sufficiently far uphole that they are in a less severe environment, for example, at a lower temperature and pressure. In this manner, the sensors P2, T2 are able to remain functioning downhole for a long period of time.

The sensors P2, T2 are, however, positioned sufficiently far downhole that their outputs are not affected by the surface temperature. As is well known to those skilled in the art, a surface temperature affected zone Z exists near the surface of each well, in which the temperature in the well is reduced due to the close proximity of the much lower temperature surface. By positioning the sensors P2, T2 below the surface temperature affected zone Z, the outputs of the sensors will each be more indicative of the conditions proximate the producing zone 82.

Other sensors may be installed at the surface. For example, another set of pressure and temperature sensors P3, T3 may be installed upstream of a surface choke C, whose size is known. Another pressure sensor P4 may be installed downstream of the choke C, so that the pressure differential across the choke may be known.

Multiple training data sets 86 are obtained while the temporary sensors P1, T1 are in the well. As depicted in FIG. 22, the training data sets 86 include outputs of the pressure and temperature sensors P1, T1, P2, T2, P3, T3, P4, the size of the surface choke C and the corresponding position of the valve V. The valve V position and/or the choke C size may be varied to produce the training data sets 86.

After the training data sets 86 are obtained, the temporary sensors P1, T1 may be retrieved from the well. A neural network 88 is trained to output the temporary sensors' P1, T1 outputs (with an acceptable margin of error) when the outputs of the other sensors P2, T2, P3, T3, P4, position of the valve V and size of the surface choke C are input to the neural network. That is, the trained neural network 88 will output the outputs of the pressure and temperature sensors P1, T1 of a particular training data set in response to the corresponding sensors' P2, T2, P3, T3, P4 outputs, valve V position and choke C size of that training data set being input to the neural network.

When the neural network 88 has been trained, it determines the outputs of the temporary sensors P1, T1 when outputs of the other sensors P2, T2, P3, T3, P4, a position of the valve V and a size of the choke C are input to the neural network, as illustrated in FIG. 23. In this manner, the temperature and pressure proximate the zone 82 may be determined, even though sensors for these parameters are not present proximate the zone 82.

Referring additionally now to FIGS. 24–27, another method 90 embodying principles of the present invention is representatively illustrated. The method 90 provides another means whereby a "virtual" sensor may be created downhole. The method 90 is similar in many respects to the method 60 described above. Specifically, a reference sensor RS capable of sensing a particular parameter, but unsuitable for extended downhole operation, is used in conjunction with downhole sensors S1, S2, S3, S4, which sense related parameters, in obtaining training data sets 92 for training a neural network 94. However, the method 90 differs in at least one substantial respect in that the downhole sensors S1, S2, S3, S4 are located at the surface when the training data sets 92 are obtained.

Figure 24:
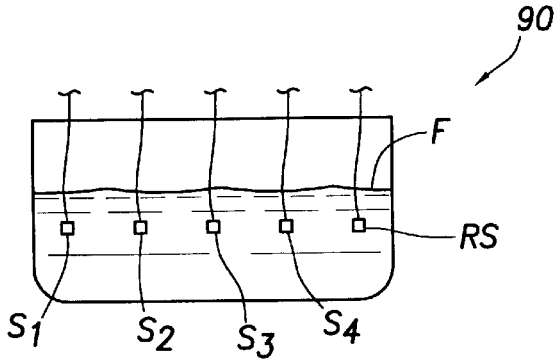
FIGS. 24–27 are schematic views of an eighth method embodying principles of the present invention.

In FIG. 24, an example is shown of a manner in which the training data sets 92 may be obtained at the surface. For this example, assume that the reference sensor RS is a fluid composition sensor The downhole sensors S1, S2, S3, S4 could, for example, sense related parameters such as resistivity, temperature, pressure and pH. However, it is to be clearly understood that the sensors RS, S1, S2, S3, S4 may sense any parameters, and any combination of parameters, without departing from the principles of the present invention. The reference sensor RS and the other downhole sensors S1, S2, S3, S4 are all exposed to various fluid compositions F at the surface, and the corresponding outputs of all of the sensors are recorded.

Figure 26:
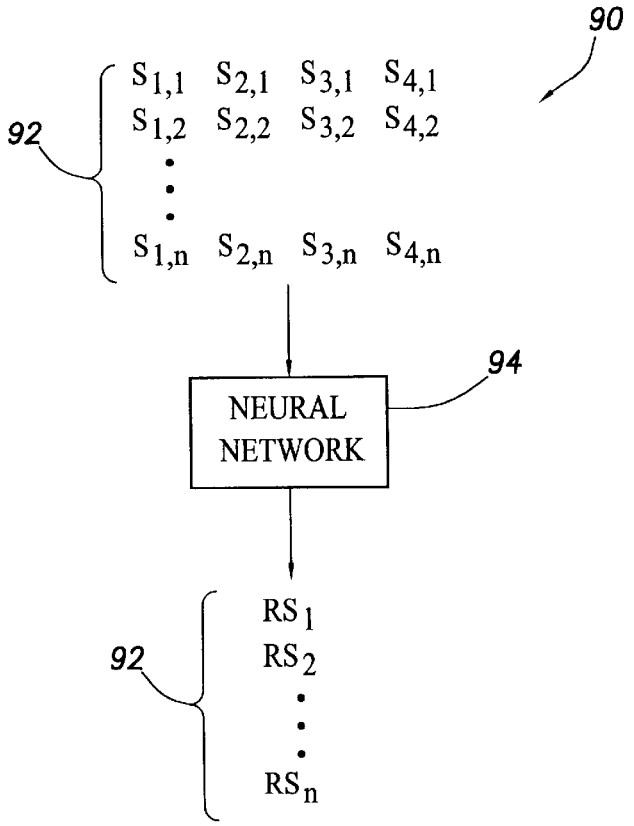

The neural network 94 is then trained, as depicted in FIG. 26, to output the reference sensor RS outputs when the corresponding other sensors' outputs S1, S2, S3, S4 are input to the neural network. That is, the trained neural network 94 will output the output of the reference sensor RS of a particular training data set in response to the other sensors' S1, S2, S3, S4 outputs of the training data set being input to the neural network. Any type of neural network may be used for the neural network 94, and the neural network may be trained and optimized using any known methods.

Figure 25:
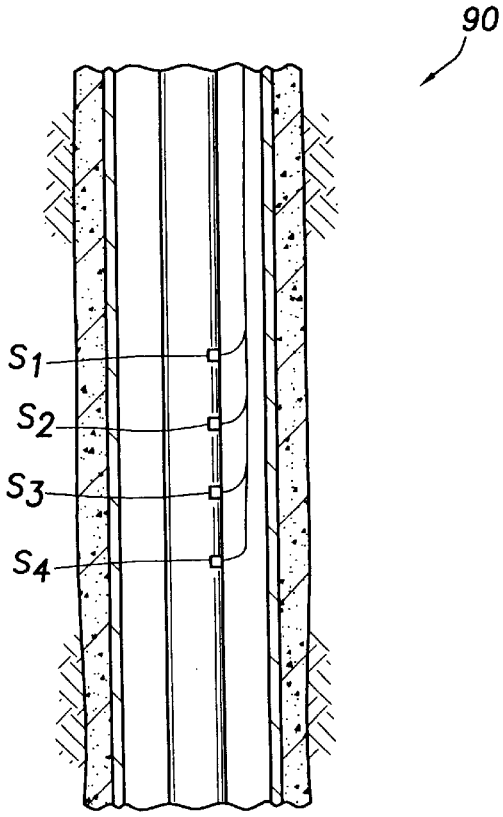
Figure 27:
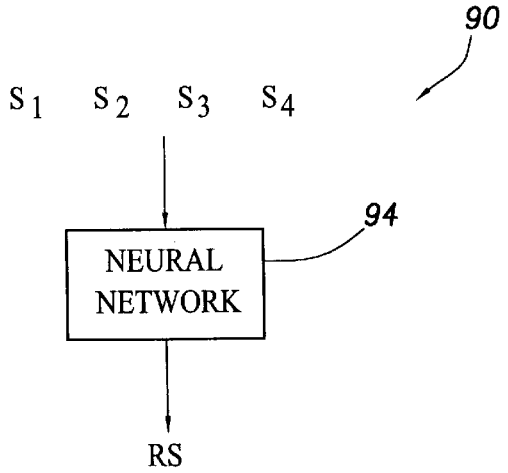

The downhole sensors S1, S2, S3, S4 are installed in the well as depicted in FIG. 25. Thereafter, outputs of the downhole sensors S1, S2, S3, S4 are input to the neural network 94 as depicted in FIG. 27. In response, the neural network 94 determines the output of the reference sensor RS, even though the reference sensor is not downhole and has not been downhole.

Thus, the method 90 permits fluid composition downhole to be determined, without the need of actually positioning a fluid composition sensor downhole. With appropriate modifications, the method 90 may be used to sense any parameter downhole, even though a sensor capable of sensing that parameter directly downhole is not available, is incapable of withstanding the well environment, is prohibitively expensive, etc.

Figure 28:
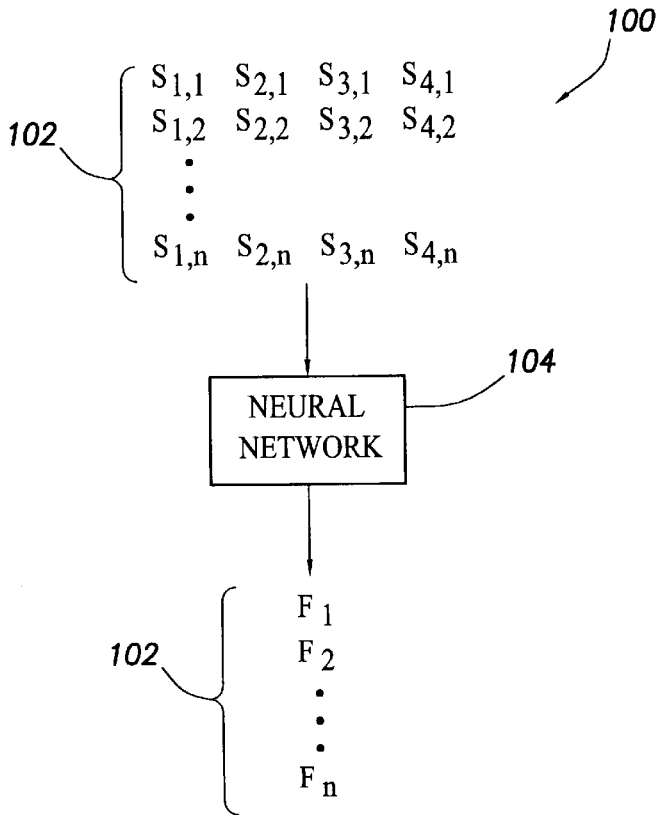
FIGS. 28–29 are schematic views of a ninth method embodying principles of the present invention.
Figure 29:
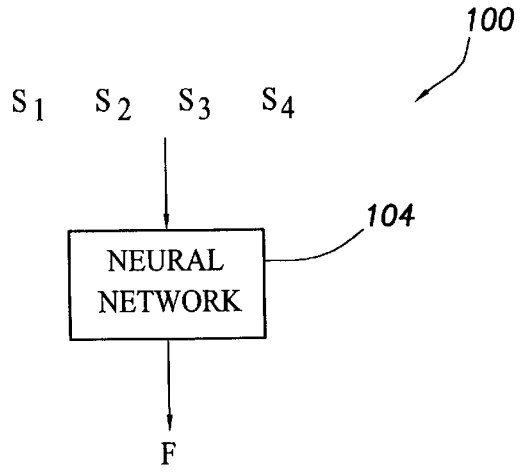

Referring additionally now to FIGS. 28 & 29, another method 100 embodying principles of the present invention is representatively illustrated. The method 100 is similar in many respects to the method 90 described above. However, instead of using a reference sensor, actual known values for the desired parameter are used. For example, where the desired parameter is fluid composition, known fluid compositions F are used when outputs of the downhole sensors S1, S2, S3, S4 are obtained for training data sets 102. Of course, desired parameters other than fluid composition may be used, without departing from the principles of the present invention.

Specifically, the sensors S1, S2, S3, S4 are all exposed to various fluid compositions F as depicted in FIG. 24, except that no reference sensor RS is used in the method 100. The outputs of the sensors S1, S2, S3, S4 are recorded along with the corresponding known fluid compositions. These sensor outputs and known compositions make up the training data sets 102.

A neural network 104 is trained using the training data sets 102. The neural network 104 is trained to output the known fluid compositions F when the sensors' S1, S2, S3, S4 outputs are input to the neural network. That is, the trained neural network 104 will output a known fluid composition F of a particular training data set when the sensors' S1, S2, S3, S4 outputs for that particular training data set are input to the neural network.

The downhole sensors S1, S2, S3, S4 are then installed in the well as depicted in FIG. 25. Thereafter, the sensors' S1, S2, S3, S4 outputs are input to the neural network 104, as depicted in FIG. 29, and in response the neural network determines the downhole fluid composition F.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. In particular, in describing the above methods 10, 30, 40, 50, 60, 70, 80, 90, 100, use is made of specific well configurations, certain types of sensors and combinations of sensors, certain inputs and outputs of neural networks, etc., in order to convey the principles of the invention to one skilled in the art, but not to limit the invention to those particular descriptions. Accordingly, the foregoing detailed description is to be clearly understood as being given by way of illustration and example only, the spirit and scope of the present invention being limited solely by the appended claims.

What is claimed is:

1. A method of sensing a downhole parameter in a well, the method comprising the steps of:

obtaining multiple training data sets including corresponding outputs of at least one temporary sensor in the well and outputs of at least one permanent sensor at the earth's surface, the temporary sensor sensing the parameter downhole and the permanent sensor sensing the parameter at the surface; and training a neural network to output the permanent sensor outputs of the training data sets in response to input to the neural network of the corresponding temporary sensor outputs of the training data sets, and the training step including inputting to the neural network outputs of at least two sensors.

2. The method according to claim 1, wherein in the obtaining step, the training data sets further include data indicative of a position of a flow control device for each corresponding temporary sensor output and permanent sensor output.

3. The method according to claim 2, wherein in the training step, the neural network is trained to output the temporary sensor outputs of the training data sets in response to input to the neural network of the corresponding permanent sensor outputs and flow control device positions.

4. The method according to claim 1, wherein in the obtaining step, the temporary sensor is temporarily conveyed into the well.

5. The method according to claim 1, wherein in the obtaining step, the temporary sensor is permanently installed in the well, but is only temporarily operable in the well.

6. The method according to claim 1, further comprising the steps of inputting to the neural network an output of the permanent sensor after the training step, and the neural network in response to the inputting step determining a corresponding output of the temporary sensor.

7. The method according to claim 6, wherein the inputting and determining steps are performed after the temporary sensor is no longer present in the well.

8. The method according to claim 6, wherein the inputting and determining steps are performed while the temporary sensor remains in the well, but is no longer operable in the well.

9. The method according to claim 6, wherein in the obtaining step the training data sets further include data indicative of a position of a flow control device for each corresponding temporary sensor output and permanent sensor output, wherein in the training step the neural network is trained to output the temporary sensor outputs of the training data sets in response to input to the neural network of the corresponding permanent sensor outputs and flow control device positions, and wherein in the inputting step data indicative of a position of the flow control device corresponding to the output of the permanent sensor after the training step is input to the neural network.

10. A method of sensing a first downhole parameter in a well, the method comprising the steps of:

obtaining multiple training data sets including corresponding outputs of a first sensor and at least one second sensor in the well, at least the first sensor sensing the first parameter downhole; and training a neural network to output the first sensor outputs of the training data sets in response to input to the neural network of the corresponding second sensor outputs of the training data sets, and the training step including inputting to the neural network outputs of at least two sensors.

11. The method according to claim 10, wherein in the obtaining step, the first sensor is a temporary sensor in the well.

12. The method according to claim 11, wherein in the obtaining step, the first sensor is temporarily conveyed into the well.

13. The method according to claim 11, wherein in the obtaining step, the first sensor is permanently installed in the well, but is only temporarily operable in the well.

14. The method according to claim 10, wherein in the obtaining step, the training data sets further include data indicative of a position of a flow control device for each corresponding first and second sensor output.

15. The method according to claim 14, wherein in the training step, the neural network is trained to output the first sensor outputs of the training data sets in response to input to the neural network of the corresponding second sensor outputs and flow control device positions.

16. The method according to claim 10, wherein in the obtaining step, the second sensor senses the first parameter downhole.

17. The method according to claim 10, wherein in the obtaining step, the second sensor senses a second parameter different from the first parameter.

18. The method according to claim 17, wherein in the obtaining step, the second sensor senses the second parameter downhole.

19. The method according to claim 10, wherein in the obtaining step, there are multiple ones of the second sensors, at least one of the second sensors sensing a second parameter downhole, the second parameter being different from the first parameter.

20. The method according to claim 10, further comprising the steps of inputting to the neural network an output of the second sensor after the training step, and the neural network in response to the inputting step determining a corresponding output of the first sensor.

21. The method according to claim 20, wherein the inputting and determining steps are performed after the first sensor no longer senses the first parameter downhole.

22. The method according to claim 20, wherein in the obtaining step the training data sets further include data indicative of a position of a flow control device for each corresponding first and second sensor output, wherein in the training step the neural network is trained to output the first sensor outputs of the training data sets in response to input to the neural network of the corresponding second sensor outputs and flow control device positions of the training data sets, and wherein in the inputting step data indicative of a position of the flow control device corresponding to the output of the second sensor after the training step is input to the neural network.

23. The method according to claim 10, wherein in the obtaining step, the second sensor senses the first parameter, the second sensor outputs being less accurate than the corresponding first sensor outputs.

24. The method according to claim 23, further comprising the steps of inputting to the neural network an output of the second sensor after the training step, and the neural network in response to the inputting step determining a corresponding output of the first sensor, the determined first sensor output having greater accuracy than the second sensor output.

25. The method according to claim 10, wherein in the obtaining step, the second sensor senses the first parameter, the second sensor outputs having less resolution than the corresponding first sensor outputs.

26. The method according to claim 25, further comprising the steps of inputting to the neural network an output of the second sensor after the training step, and the neural network in response to the inputting step determining a corresponding output of the first sensor, the determined first sensor output having greater resolution than the second sensor output.

27. The method according to claim 10, wherein in the obtaining step, the second sensor is disposed in a shallower portion of the well than the first sensor.

28. The method according to claim 27, wherein in the obtaining step, the second sensor is disposed below a portion of the well affected by surface temperature.

29. The method according to claim 27, wherein in the obtaining step, the training data sets further include outputs of at least one third sensor at the earth's surface, data indicative of a position of a flow control device in the well for each corresponding first, second and third sensor output, and data indicative of a flow restriction through a choke for each corresponding first, second and third sensor output.

30. The method according to claim 29, wherein in the training step, the neural network is trained to output the first sensor outputs of the training data steps in response to input to the neural network of the corresponding second and third sensor outputs, the flow control device position data and the choke flow restriction data of the training data sets.

31. The method according to claim 29, wherein in the obtaining step, the third sensor outputs are indicative of a pressure drop across the choke.

32. The method according to claim 10, wherein in the obtaining step, the first sensor is subjected to greater fluid pressure in the well than the second sensor.

33. The method according to claim 10, wherein in the obtaining step, the first sensor is subjected to greater temperature in the well than the second sensor.

34. A method of sensing downhole parameters in a well, the method comprising the steps of:

obtaining multiple first training data sets including corresponding outputs of a first sensor and at least one second sensor in the well for a first zone intersected by the well, at least the first sensor sensing a first parameter downhole;

obtaining multiple second training data sets including corresponding outputs of a third sensor and at least one fourth sensor in the well for a second zone intersected by the well, at least the third sensor sensing a second parameter downhole;

training a first neural network to output the first sensor outputs of the first training data sets in response to input to the first neural network of the corresponding second sensor outputs of the first training data sets, and the first neural network training step including inputting to the first neural network outputs of multiple sensors; and training a second neural network to output the third sensor outputs of the second training data sets in response to input to the second neural network of the corresponding fourth sensor outputs of the second training data sets, and the second neural network training step including inputting to the second neural network outputs of multiple sensors.

35. The method according to claim 34, wherein the first and third sensors are the same sensor disposed at different positions in the well.

36. The method according to claim 34, further comprising the steps of inputting to the first neural network an output of the second sensor after the first neural network training step, the first neural network in response determining a corresponding output of the first sensor, and inputting to the second neural network an output of the fourth sensor after the second neural network training step, the second neural network in response determining a corresponding output of the third sensor.

37. The method according to claim 34, wherein in the first training data sets obtaining step the first parameter is indicative of production from the first zone, and wherein in the second training data sets obtaining step the second parameter is indicative of production from the second zone.

38. A method of sensing a first downhole parameter in a well, the method comprising the steps of:

obtaining multiple training data sets including corresponding outputs of a reference sensor and at least one downhole sensor, the reference sensor and downhole sensor being disposed at the earth's surface when the outputs are obtained; and training a neural network to output the reference sensor outputs of the training data sets in response to input to the neural network of the corresponding downhole sensor outputs of the training data sets, and the training step including inputting to the neural network outputs of at least two sensors.

39. The method according to claim 38, further comprising the steps of positioning the downhole sensor in the well after the training step, inputting to the neural network an output of the downhole sensor after the positioning step, and the neural network in response to the inputting step determining a corresponding output of the reference sensor.

40. The method according to claim 38, wherein in the obtaining step, the reference sensor senses the first parameter and the downhole sensor senses a second parameter different from the first parameter.

41. The method according to claim 38, wherein in the obtaining step, there are multiple ones of the downhole sensor, the reference sensor sensing the first parameter, and each of the downhole sensors sensing a respective parameter different from the first parameter.

42. The method according to claim 38, wherein in the obtaining step, the reference and downhole sensors are exposed to multiple varied fluid compositions at the surface to obtain the corresponding outputs for the training data sets.

43. The method according to claim 42, wherein the first parameter is fluid composition, and wherein in the obtaining step the reference sensor outputs are indicative of the corresponding surface fluid compositions.

44. The method according to claim 43, wherein in the obtaining step, the downhole sensor outputs are indicative of at least one second parameter other than fluid composition.

45. The method according to claim 44, further comprising the steps of positioning the downhole sensor in the well after the training step, exposing the downhole sensor to a downhole fluid composition in the well, inputting to the neural network an output of the downhole sensor obtained during the exposing step, and the neural network in response to the inputting step determining the downhole fluid composition.

* * * * *